US011535984B2

(12) United States Patent
Lindblom

(10) Patent No.: US 11,535,984 B2
(45) Date of Patent: Dec. 27, 2022

(54) REFINER SEGMENT

(71) Applicant: VALMET AB, Sundsvall (SE)

(72) Inventor: Thommy Lindblom, Hägersten (SE)

(73) Assignee: VALMET AB, Sundsvall (SE)

( * ) Notice: Subject to any disclaimer, the term of this patent is extended or adjusted under 35 U.S.C. 154(b) by 80 days.

(21) Appl. No.: 16/971,344

(22) PCT Filed: Jan. 22, 2019

(86) PCT No.: PCT/SE2019/050038
§ 371 (c)(1),
(2) Date: Aug. 20, 2020

(87) PCT Pub. No.: WO2019/164433
PCT Pub. Date: Aug. 29, 2019

(65) Prior Publication Data

US 2021/0017706 A1 Jan. 21, 2021

(30) Foreign Application Priority Data

Feb. 21, 2018 (SE) ..... 1850192-4

(51) Int. Cl.
*D21D 1/30* (2006.01)
*B02C 7/12* (2006.01)

(52) U.S. Cl.
CPC ..... *D21D 1/306* (2013.01); *B02C 7/12* (2013.01); *D21D 1/303* (2013.01)

(58) Field of Classification Search
CPC ..... D21D 1/30; D21D 1/303; D21D 1/306; B02C 7/12
See application file for complete search history.

(56) References Cited

U.S. PATENT DOCUMENTS 11,665 A * 9/1854 Dickson ..... B02C 7/12 241/296
191,740 A * 6/1877 Williams ..... B02C 7/12 241/296

(Continued)

FOREIGN PATENT DOCUMENTS

EP 0611599 A1 8/1994
WO WO 2012/115526 A1 8/2012

OTHER PUBLICATIONS

Extended European Search Report, Application No. 19758005.3, dated Oct. 27, 2021, 7 pages.

*Primary Examiner* — Faye Francis
(74) *Attorney, Agent, or Firm* — Foley & Lardner LLP

(57) ABSTRACT

A refiner segment that includes a center area. The refiner segment includes a number N, N≥2, of bar zone that are arranged at different radial positions with regard to a radial direction R extending from the center area of the refiner disc towards the periphery of the refiner segment. Each of the bar zones are defined by a corresponding set of refining bars that are distributed angularly and encircles the center area. The refining bars belonging to different but neighboring bar zones are angularly offset and refining bars belonging to different but neighboring bar zones are arranged in such a way that a tangential direction of a particular refining bar belonging to a bar zone points in a direction towards the mid-point between two refining bars belonging to a neighboring bar zone.

13 Claims, 8 Drawing Sheets

(56) References Cited

U.S. PATENT DOCUMENTS

| | | | | | |
|---|---|---|---|---|---|
| 257,623 | A * | 5/1882 | Speer | B02C 7/12 | 241/296 |
| 316,478 | A * | 4/1885 | McKee | B02C 7/12 | 241/296 |
| 858,267 | A * | 6/1907 | Dellinger | B02C 7/12 | 241/296 |
| 1,595,282 | A * | 8/1926 | Bauer | B02C 7/13 | 241/296 |
| 3,149,792 | A | 9/1964 | Textor | | |
| 3,815,834 | A * | 6/1974 | Gilbert | D21D 1/30 | 241/296 |
| 4,039,154 | A * | 8/1977 | Peterson | D21D 1/306 | 241/261.3 |
| 5,112,443 | A | 5/1992 | Virving et al. | | |
| 5,383,617 | A * | 1/1995 | Deuchars | B02C 7/12 | 241/296 |
| 5,683,048 | A | 11/1997 | Virving | | |
| 5,704,559 | A * | 1/1998 | Froberg | B02C 7/12 | 241/261.3 |
| 6,443,353 | B1 | 9/2002 | Kleinschnittger et al. | | |
| 2004/0149844 | A1 | 8/2004 | Antensteiner | | |
| 2007/0164143 | A1* | 7/2007 | Sabourin | D21D 1/306 | 241/297 |
| 2011/0155828 | A1 | 6/2011 | Gingras | | |
| 2013/0270377 | A1* | 10/2013 | Gingras | D21B 1/26 | 241/220 |
| 2017/0073893 | A1* | 3/2017 | Bilodeau | D21C 9/007 | |
| 2018/0345291 | A1* | 12/2018 | Knight | D21D 1/306 | |

* cited by examiner

REFINER SEGMENT

TECHNICAL FIELD

The proposed technology generally relates to refiner segments for a refiner of lignocellulosic material. More specifically it relates to a refiner segment that is provided with refining bars arranged in different bar zones on the refiner segment surface. Embodiments herein also relates to a refiner rotor or a refiner stator comprising refining segments with refining bars arranged in different bar zones. Another embodiment of the proposed technology provides a refiner comprising at least one of a refiner rotor or a refiner stator provided with refiner segments having refining bars arranged in different bar zones on the refiner segment surface.

BACKGROUND

To mechanically produce pulp or fibers from lignocellulosic material, e.g, wood, wood chips are fed into a refiner which refines the prepared, e.g., the steamed wood chips into fiber or pulp. This sounds simple enough but to do it an efficient and continuous manner poses substantial challenges. To make the process as efficient as possible one needs to be able to refine with a stable disc gap and this will in turn require at least two things:

i) feeding efficiency, i.e., one needs to obtain a fiber or pulp feed with only minor restrictions, and ii) feeding consistency, e.g., one needs to obtain a material feed displaying only a minor variation. Unfortunately, there are things that work against you when trying to achieve the above. There are for example variations in the material characteristics that resides from earlier process stages, e.g., since wood is an organic material it is never quite the same. All wood chips are for example not cooked in exactly the same manner. Feeding the wood chips into the refiner itself in a consistent continuous manner is also a challenge. There is always the risk that the material feed into the refiner or the refining area is perturbed by some hard to control disturbances. Back-streaming of steam produced during wood chip refining provides a particular example of such a hard to control disturbance. Back-streaming of steam occurs regularly since most of the moisture carried by the chips will turn into steam and some of the steam will propagate backwards, against the material flow, and interfere and disturb the incoming material/chip flow.

Designing a refiner is therefore subject to a lot of challenges that need to be fulfilled in order to ensure an efficient feeding and subsequent grinding of e.g., wood chips. When it comes to feeding efficiency it is beneficial if the material can be fed into the grinding area or grinding zone with as small restrictions or disturbances as possible. A common refiner of lignocellulosic material usually comprises a rotor unit and a stator unit that are aligned along a pulp feeding axis facing each other. The refining of the material is performed in a bounded area between the rotor unit and the stator unit. During use of the refiner, material, e.g., pulp, is fed into an area arranged in between, and bounded by, the stator unit and a rotor unit. The rotor unit facing the stator unit may in particular versions be arranged on a rotatable shaft that can be rotated by means of an electrical motor. The purpose of the rotor unit, which in the following will be simply referred to as a rotor, is to grind the pulp between a surface of the stator unit and a surface of the rotor. The rotor and/or stator are often provided with refining segments on their surfaces. The purpose of these refining segments is to improve the grinding action on the material. The refining segments are in turn often provided with additional structures to improve the refining action even further. These structures often comprises refining bars arranged on the surface of the rotor and/or the stator. The refining bars protrudes from the surface of the rotor disc/stator disc and faces the material flow. To ensure an efficient material flow in the area between the stator and rotor these refining bars must be provided in a fashion where they disturb the material flow as little as possible while they at the same time produces an efficient grinding of the material. It is a highly non-trivial challenge to fulfill both these criteria's.

The proposed technology aims to overcome at least some of the challenges associated with the design of refining segments for a refiner of e.g., lignocellulosic material.

SUMMARY

It is an object to provide a refining segment that enables an efficient material flow while at the same time allowing for an efficient grinding action.

It is a further object to provide a refining segment that allows steam produced during the refining process to stream backwards, toward the material feeding flow, with a reduced influence on the flow.

It is yet another object to provide a rotor or rotor disc comprising such a refining segment. An additional object is to provide a refiner comprising such a rotor.

These and other objects are met by embodiments of the proposed technology.

According to a first aspect, there is provided a refiner segment for a refiner of lignocellulosic material, the refiner segment being part of a refiner disc comprising a center area, wherein the refiner segment comprises a number N, N≥2, of bar zones arranged at different radial positions with regard to a radial direction R extending from the center area of the refiner disc towards the periphery of the refiner segment, each of the bar zones being defined by a corresponding set of refining bars distributed angularly and encircling the center area, where refining bars belonging to different but neighboring bar zones are angularly offset and where refining bars belonging to different but neighboring bar zones are arranged in such a way that a tangential direction of a particular refining bar belonging to a bar zone points in a direction towards the mid-point between two refining bars belonging to a neighboring bar zone and wherein the length of refining bars belonging to different bar zones decreases from a largest length for refining bars belonging to the innermost bar zone, with regard to the center of said refining disc, to the smallest length for refining bars belonging to the outermost bar zone adjacent the periphery of said refiner segment.

According to a second aspect of the proposed technology there is provided a refiner segment according to the first aspect, wherein the refiner disc is a rotor refiner disc.

According to a third aspect there is provided a refiner comprising a rotor refiner disc according to the second aspect.

Embodiments of the proposed technology provides refiner segments together with corresponding rotor discs, stator discs and refiners that yield both an efficient material flow within an into the refiners refining area and an efficient refining action on lignocellulosic material such as e.g., wood.

Other advantages will be appreciated when reading the detailed description.

BRIEF DESCRIPTION OF THE DRAWINGS

The embodiments, together with further objects and advantages thereof, may best be understood by making reference to the following description taken together with the accompanying drawings, in which.

DETAILED DESCRIPTION

Throughout the drawings, the same reference designations are used for similar or corresponding elements.

For a better understanding of the proposed technology, it may be useful to begin with a brief overview of an example of a traditional refiner where the proposed technology may be used. This will then be followed by an analysis of the technical problems and challenges associated with the design of refiner segments.

Figure 8:
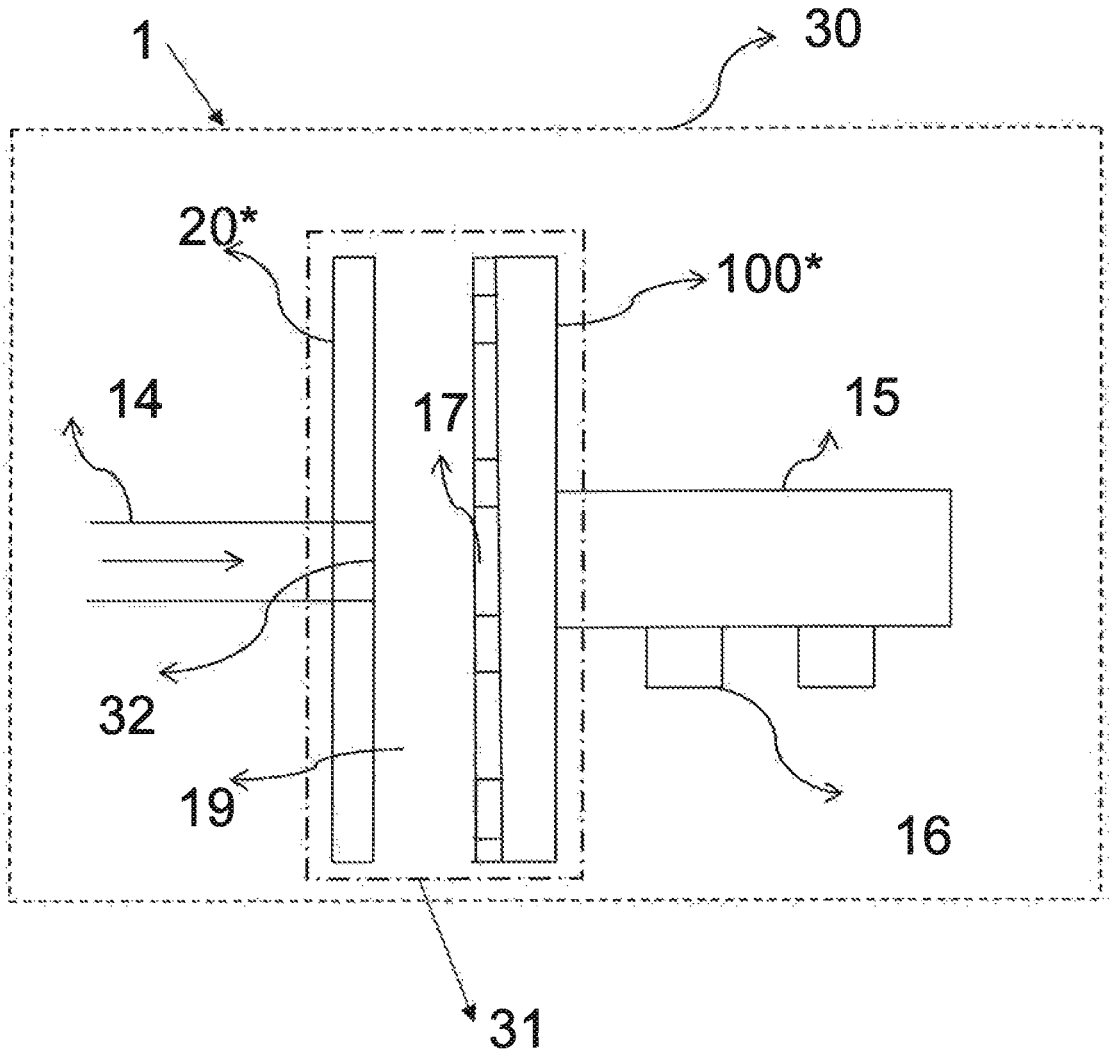
FIG. 8 is a schematic diagram of a refiner where the proposed technology can be used.

In order to describe a refiner reference is made to FIG. 8 which schematically shows an exemplary pulp refiner in a cross-sectional view. The arrangement is housed in a housing 30 that represents the outer casing of the refiner device together with all components of the device that is not essential for understanding the present invention. Examples of components not shown are an electrical motor for driving e.g. the rotation shaft, the feeding mechanism for the lignocellulosic material etc. Inside a second housing 31 a rotor 100* and a stator 20* is linearly aligned along a shaft. The rotor is attached to a rotation shaft 15 arranged on bearings 16. The rotation shaft 15 is connected to a motor, not shown, that rotates the shaft 15, and thus the rotor 10. The stator 20* facing the rotor 100* can be provided with a centrally located through hole 32 that extends between a feeding channel 14 for lignocellulosic material and a refining area 19. The rotor 100 can in certain embodiments be provided with a center plate 17 having a surface facing the incoming flow of lignocellulosic material. The surface of the center plate 17 can be provided with structures that will direct the lignocellulosic material outwards. The rotor 100* and/or the stator 20*, also referred to as rotor (refiner) discs and stator (refiner) discs, respectively, are provided with refining segments to enable steering and grinding of the pulp. These grinding segments are often provided with protrusions on the surfaces intended to enhance the grinding action of the pulp.

During use, lignocellulosic material such as wood chips or prepared wood, e.g., pulp, will be fed by means of a feeding mechanism, not shown, through the feeding channel 14. The material will pass through the hole 32 in the stator 20* and enter an area 19. The area 19 is essentially defined by the open area between the rotor 100* and the stator 20* and this area can be quite small during operation. The lignocellulosic material flowing into the area 19 will be incident on the center plate 17 on the rotor 100*. The center plate 17 acts to steer the lignocellulosic material out towards the refining segments on the rotor and/stator.

Figure 7:
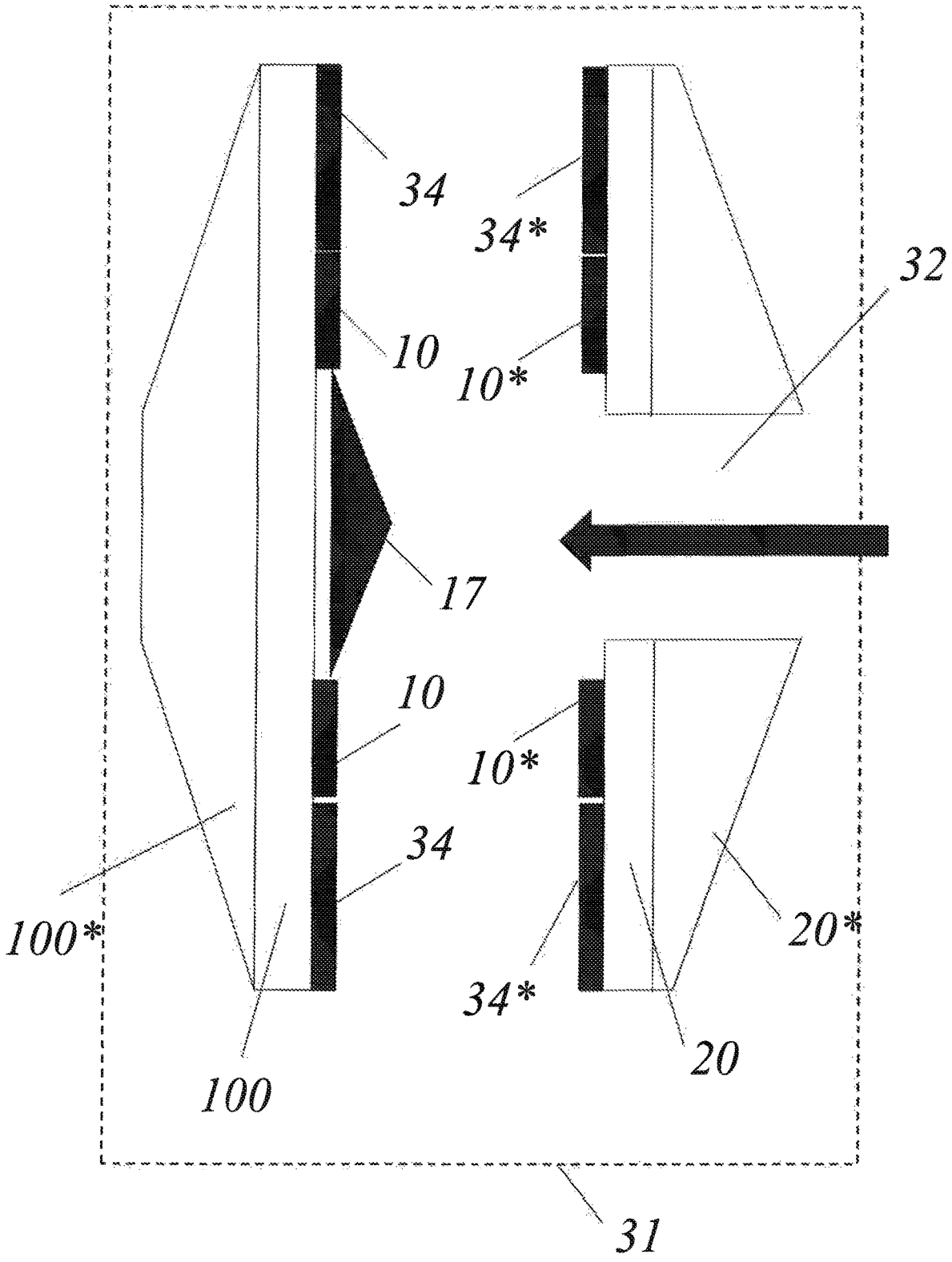
FIG. 7 is a schematic diagram illustrating a cross-sectional view from the side of a rotor and stator arrangement where the proposed technology may be used.

In order to provide a more detailed description of a rotor-stator arrangement in which the proposed technology may be used reference is made to FIG. 7. FIG. 7 illustrates a cross-sectional side view of a rotor stator arrangement housed in a housing 31 in a refiner as e.g., described above. Shown is a rotor 100* that is arranged to rotate around a rotation shaft. The rotor 100* is provided, on the surface facing the stator 20*, with a refining disc 100. The stator 20* is provided, on the surface facing the rotor 100*, with a refining disc 20. The refining discs 100, 20 may in certain versions of a refiner be referred to as a segment holders since one of the purposes of the refining discs 100, 20 is to carry refining segments. In this rotor-stator arrangements the refining discs of the rotor 100* and the stator 20* are provided with two different types of refining segments, a first type of refining segments 10, 10*, referred to as inlet segments, and a second type of refining segments 34, 34*, referred to as refining zone segments. In certain refiner versions, e.g., in large refiners, these segments are sometimes referred to as center segments or c-segments 10, 10* and peripheral segments, or p-segments 34, 34*, respectively. In what follows the segments will be referred to as c-segments and p-segments but it should be noted that it actually relates to inlet segments and refining zone segments. There is a dual purpose with the first type of segment 10, 10*; it should provide an efficient grinding of lignocellulosic material but it should also enable an efficient material flow towards the p-segments 34, 34*. In the area between p-segments arranged on the rotor and the stator, respectively, the main refining action takes place. The disc gap between these p-segments is normally smaller than the disc gap between the c-segments in order to enhance the refining action. A common disc gap between the p-segments is of order 0.5 mm. Also illustrated in FIG. 7 is an inlet 32 for the lignocellulosic material subject to refining. The inlet 32 is arranged in the central area of the stator 20*. Arranged in the center area of the refining disc 100 on the rotor side, opposing the inlet 32, is a center plate 17. The purpose of the center plate 17, which was described above with reference to FIG. 8, is to distribute material that falls in from the inlet 32 towards the outer sections of the refining disc 100. That is, the center plate 17 acts to distribute the material towards the c-segments and the subsequent p-segments arranged on the refiner discs. The proposed technology relates to refining segments of the c-segment type, i.e., the type of refining segments that acts to ensure both an effective refining action and an effective steering of the material flow towards the refining segments of the p-segment type 34.

Having described a potential working mode for a refiner it should be clear that the demands put on a refiner segment are quite high and often contradictory. The refining bars provided on the refiner segment aims to provide an efficient grinding action on the incoming material, a purpose that suggest that they should be given a prominent structure, i.e., they should protrude from the surface of the refiner segments. An efficient and even grinding or refining of the material requires however also that the incoming material is evenly distributed in the refining area. A general configuration of refining bars on a refining segment may however cause areas of varying material concentration. The refining bars should therefore be arranged on the refining segment in such a way that the incoming flow of lignocellulosic material gets evenly distributed and can be steered in a controlled manner towards the outer refining areas, e.g., towards the refining segments of p-segment type. The dual purposes of the refining bars make the design of a refining segment very tricky. One additional and substantial problem that negatively affects the material flow is the impact caused by water steam produced during the refining of the material. Since the material to be refined naturally comprises water, the substantial pressure in the housed rotor and stator arrangement will produce significant amounts of water steam. It should also be noted that there, during use of the refiner, is present a pressure peak in the vicinity of the p-segments, this pressure peak posits a hindrance to the possible motion of the water steam and a lot of the produced water steam will as a consequence move backwards toward the center of the arrangement, i.e., towards the material inlet 32. This backward directed movement of steam will interact with the incoming material flow and make it harder to achieve an even material flow without substantial material concentrations.

The proposed technology provides a refiner segment whose design has shown to provide a satisfactory refining action while at the same time ensuring an efficient and controlled flow of lignocellulosic material. The proposed technology provides in particular mechanisms that will reduce the negative impact the back-travelling steam have on the material flow. This is accomplished at least in part due to a particular configuration of refining bars that will enable the main material flow to occur on one refining disc side, e.g., on the rotor side of a rotor-stator arrangement while the other refining disc side, e.g., the stator side, can be occupied by back-travelling water steam. This will reduce the interaction between incoming wood chips and back-travelling water steam.

In order to obtain these positive effects the proposed technology provides a refiner segment 10 for a refiner 1 of lignocellulosic material. The refiner segment 10 being part of a refiner disc 100 comprising a center area 11, wherein the refiner segment 10 comprises a number N, N≥2, of bar zones $Z_i$, i=1, 2, . . . N arranged at different radial positions with regard to a radial direction R extending from the center area 11 of the refiner disc 100 towards the periphery of the refiner segment 10, each of the bar zones $Z_i$ being defined by a corresponding set of refining bars $Z_i^{RBi}$, i=1, 2, . . . M, distributed angularly and encircling the centrally located through-hole 11, where refining bars $Z_i^{RBi}$ belonging to different but neighboring bar zones $Z_i$, $Z_{i+1}$ are angularly offset.

Figure 1:
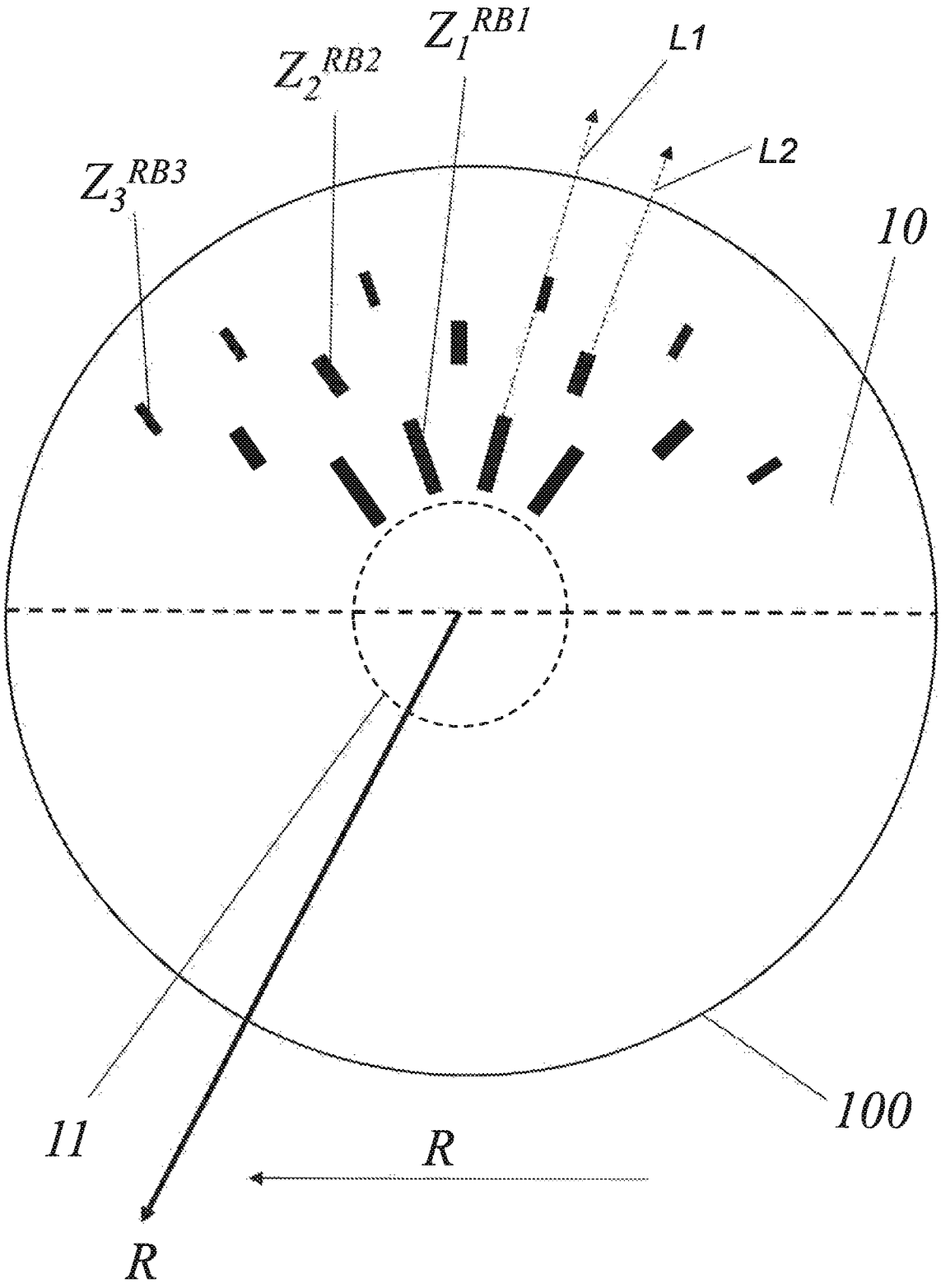
FIG. 1 is a schematic drawing of a refining segment according to the proposed technology.
Figure 5A:
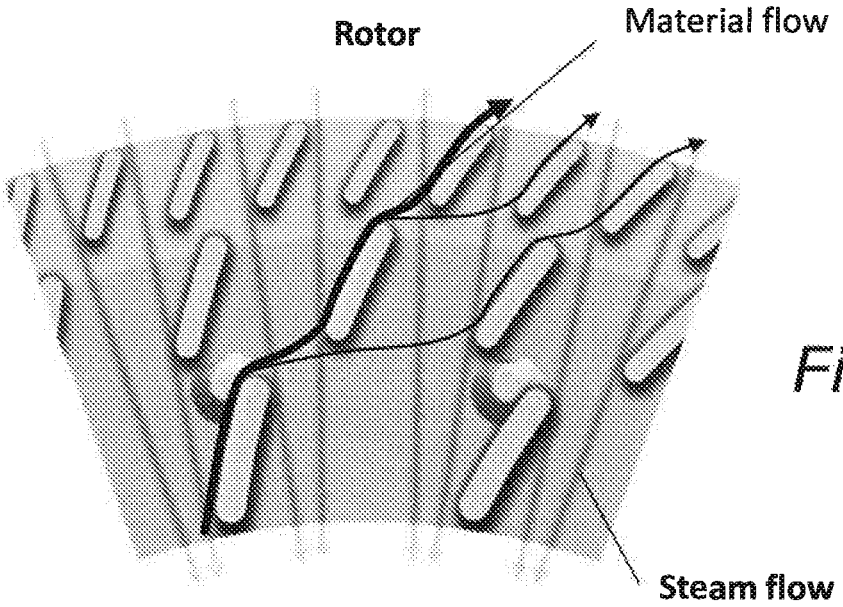
FIG. 5*a* is a schematic drawing of a refining segment for a rotor according to the proposed technology which also illustrates potential material- and steam flows.

In other words, there is provided a refiner segment 10 that is integrated with a refining disc 100, or is adapted to be attached to a refining disc 100. The refining segment have a surface that comprises a number of refining bars $Z_i^{RBi}$ that are arranged in an angular fashion around a common center area 11 in such a way that they form distinct bar zones $Z_i$ that encircles a common center on the refining disc 100. A particular bar zone $Z_i$ is defined as the area on the refining segment that comprises a corresponding set of refining bars $Z_i^{RBi}$. Hence a number of refining bars $Z_1^{RB1}$ are provided in an innermost area, corresponding to bar zone $Z_1$, with regard to the center area of the refiner disc 100, a number of refining bars $Z_2^{RB2}$ are provided in an area, corresponding to bar zone $Z_2$, that lies outside the innermost area. The directions are in relation to a radial direction having its origin in the center 11 of the refiner disc 100. This pattern is repeated so that a number of concentric bar zones are defined along the surface of the refining segment 100. Each bar zone comprises its own refining bars and refining bars belonging to neighboring bar zones may be spatially offset, i.e., arranged in such a way that there is a radial distance between refining bars belonging to neighboring bar zones. This is for example illustrated in FIG. 1. A particular feature of the proposed refining segment 10 is that refining bars $Z_i^{RBi}$ that belong to different but neighboring bar zones $Z_i$ and $Z_{i+1}$ are angularly offset. That is, they are arranged in such a fashion that the length direction of specific refining bars belonging to different but neighboring bar zones does not coincide. This can for example be seen in FIG. 1 and FIG. 2 where the length directions for refining bars belonging to bar zone $Z_1$ and $Z_2$ has been illustrated by means of dotted arrows, labelled L1 and L2, respectively. This angular offset between refining bars belonging to different but neighboring bar zones creates open bar areas that will allow material sub-flows to move over to the following, i.e., the neighboring, bar zone in a particular manner. This refining bar pattern has proved effective for achieving an even material flow over the refining segment towards the periphery, or towards the p-segments. It has in particular shown to be an efficient counter measure to the problem associated with water steam going backwards. The proposed refining segment ensures that the material flow along a particular refining segment is not forced towards the oppositely arranged refining disc, e.g., towards the stator side, if the refining segment is provided on the rotor side. Due to this fact the oppositely arranged refining disc will display a lot of open area which may be occupied by any water steam travelling backwards. Any residual amount of steam that might end up on e.g., the rotor side would still have space to move towards the center through the openings provided by the open areas between the refining bars. To appreciate this technical effect reference is made to FIG. 5*a* which illustrates a rotor disc comprising a refining segment according to the proposed technology. The schematic drawing illustrates both the path the material flow will take and the number of ways that the steam can travel. The refining bars that are angularly offset provides a smooth way for the material to follow while it also provides way for the movement of steam.

There are a number of advantages that can be obtained with refining segments according to the proposed technology. They provide in particular an energy economical feeding with minimum restrictions. The refining segment of the proposed technology provides a lot of open volume. This open volume can carry the material flow without forcing it towards the opposite side of the rotor-stator arrangement. The proposed refining segment also provide the highly desirable feature that it enables an even feed not only over the spatial disc geometry but also over time, and in particular a uniform flow over time despite the fact that the incoming material feed itself might be non-uniform. The proposed technology enables this feature by having a refining bar pattern that allows a material buffering effect. When sub-flows over the refining segments emerges from one bar zone and reaches a new bar zone, the sub-flows will mix with already existing flows. This mixing of sub-flows paired with potential turbulence and friction caused by the mixing will yield a slight material buffering effect. This buffering effect will in turn ensure a more uniform material flow over time.

Having described the cooperating features of a refining segment 10 that enables both an efficient grinding of the material and an efficient material flow, in what follows a number of embodiments of the proposed technology will be described with reference to the accompanying drawings. Other embodiments, however, are contained within the scope of the subject matter disclosed herein, the disclosed subject matter should not be construed as limited to only the embodiments set forth herein; rather, these embodiments are provided by way of example to convey the scope of the subject matter to those skilled in the art.

A particular embodiment of the proposed technology provides a refiner segment 10 wherein the angular offset between all neighboring bar zones $Z_i$ are in the same angular direction, the angular direction being the direction opposite to the intended rotational direction of the refiner segment 10. This embodiment provides an improved material flow since at least some of the refining bars belonging to different but neighboring bar zones can cooperate to obtain a uniform flow both spatially and over time. This embodiment is illustrated schematically in FIG. 5A.

Another embodiment of the proposed technology provides a refiner segment 10, wherein the refining bars of a particular bar zone are distributed angularly in a band of essentially equidistantly spaced refining bars $Z_i^{RBi}$ that encircles the center 11 of the refiner disc 100. This embodiment is schematically illustrated in, for example, FIG. 2. It can be seen in FIG. 2 how refining bars belonging to the same bar zone are arranged equidistant to each other in an angular pattern. Since they form part of the same band they are also arranged more or less equidistantly from a center of the disc. This particular embodiment ensures a symmetric configuration of refining bars which in turn has shown to lead to an even material flow. There are however alternative embodiments where the shape of the refining bar pattern can be adjusted to improve the material feeding for different radii.

Figure 3A:
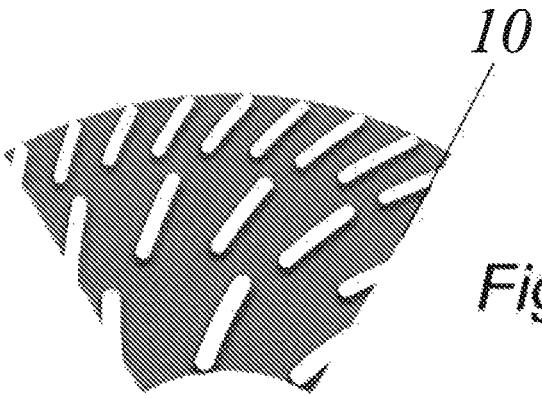
FIG. 3*a* is a schematic drawing of a refining segment having three bar zones according to the proposed technology.
Figure 3B:
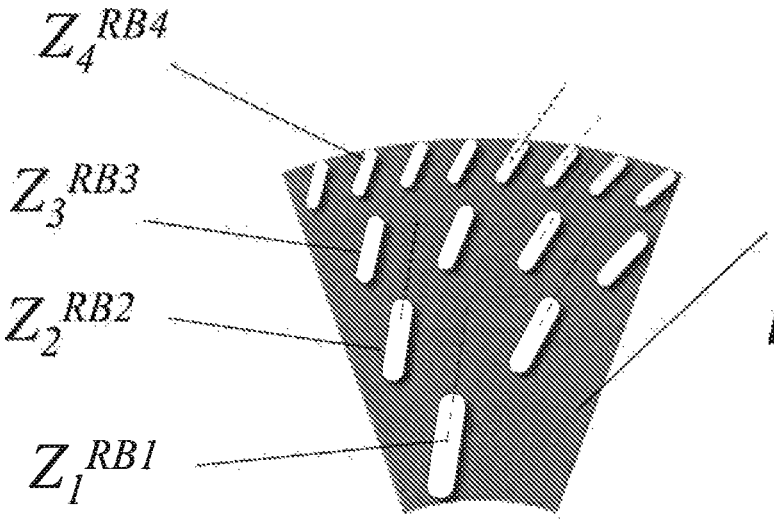
FIG. 3*b* is a schematic drawing of a refining segment according to the proposed technology where the bar zones comprises four bar zones and essentially straight refining bars.
Figure 3C:
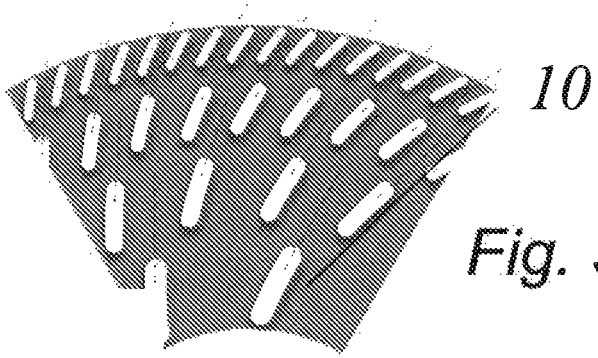
FIG. 3*c* is a schematic drawing of a refining segment according to the proposed technology where the refining segment comprises four bar zones with slightly curved refining bars.
Figure 4:
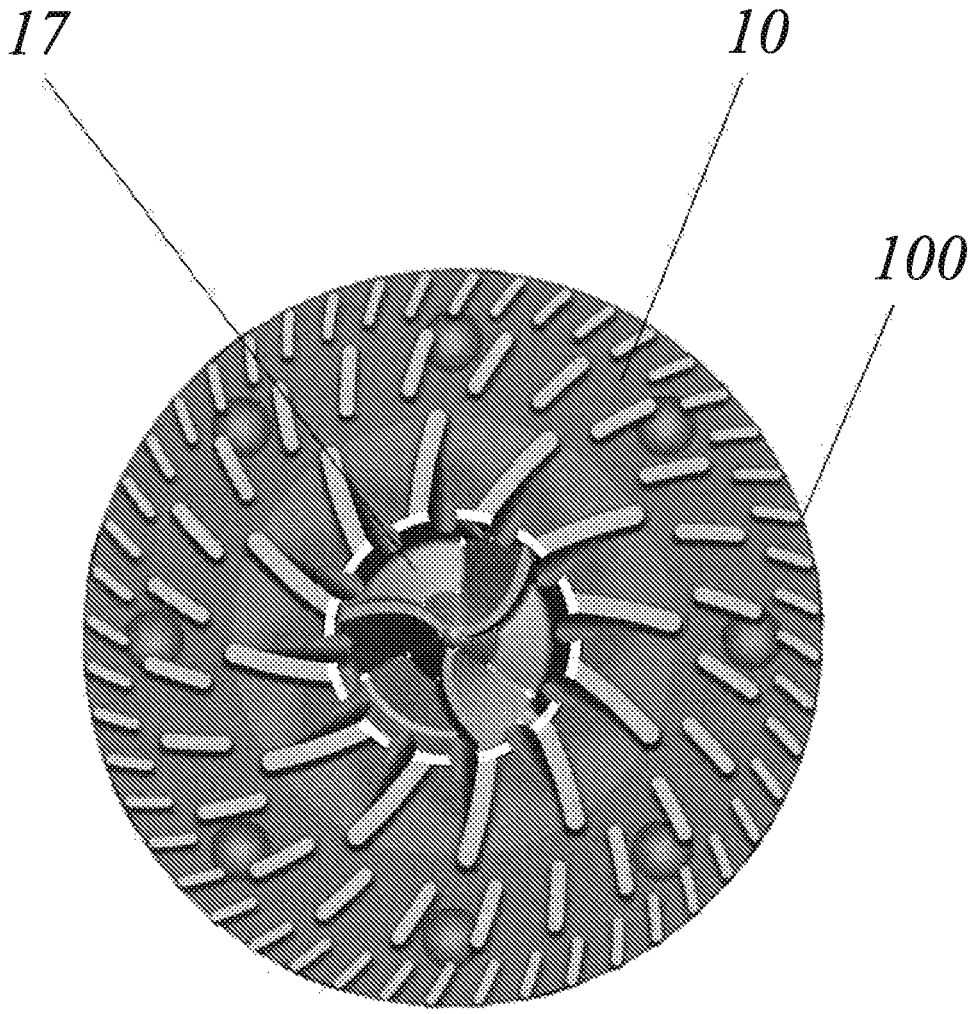
FIG. 4 is a schematic drawing of a refining segment according to the proposed technology arranged on a rotor refiner disc where the central area of the refiner disc comprises a center plate.

Yet another particular embodiment of the proposed technology provides a refiner segment 10, wherein the different bar zones comprises bands with different number of equidistantly spaced refining bars $Z_i^{RBi}$. Such an embodiment is illustrated in FIGS. 3*a*-3*c*. In FIG. 3*a*, which illustrates a refining segment with three different bar zones, the innermost bar zone is provided a number of refining bars. In the bar zone that is adjacent to the innermost bar zone the number of refining bars are higher. This pattern may than be repeated for each additional bar zone. Still another particular embodiment of the proposed technology provides a refiner segment 10, wherein the number of equidistantly spaced refining bars $Z_i^{RBi}$ increases from the lowest number in the innermost bar zone $Z_1$, with regard to the center 11 of the refiner disc 100, to the highest number in the outermost bar zone $Z_N$ adjacent the periphery of the refiner segment 10. According to a specific embodiment the number of refining bars provided in the bar zones can be doubled for each bar zone going outwards towards the periphery. If the innermost bar zone $Z_1$ is provided with a number X of refining bars, the zone $Z_2$ that is adjacent to the zone $Z_1$ is provide with 2X bars and so on. By providing more bars towards the periphery of the refining segment the difference between the available open volumes in the center compared to the outermost bar zone is reduced. This is in particular true when the size of the refining bars gets smaller in bar zones closer to the periphery of the refining segment. Achieving an even distribution of open volume will enable a more even flow.

By way of example, the proposed technology provides a refiner segment 10, wherein refining bars $Z_i^{RBi}$ belonging to different but neighboring bar zones are arranged in such a way that a tangential direction of a particular refining bar $Z_k^{RBk}$ belonging to a bar zone $Z_i$, points in a direction towards the mid-point between two refining bars $Z_{k+1}^{RBk+1}$ belonging to a neighboring bar zone $Z_i$, $Z_{i+1}$. FIG. 3*b* provides an illustration of this particular embodiment. The dotted lines illustrates the tangential direction of a refining bar. In the case of essentially straight refining bars, the tangential direction will coincide with the length direction of the refining bar while the tangential direction for a curved refining bar essentially follows the slope of the curvature of the refining bars. The latter case is schematically illustrated in FIG. 3*c*, where the dotted lines illustrates the tangential direction for slightly curved refining bars. The embodiments where refining bars belonging to different bar zones or bands are arranged based on the tangential direction of refining bars belonging to the inner bar zone or band ensures an efficient material flow since it provides a lot of open area that can carry the material flow.

A specific embodiment of the proposed technology provides a refiner segment 10, wherein the refining bars are provided with geometrical shapes such as straight edged bars, rounded bars, conical bars, arrow-shaped bars with or without chamfers, etc. By way of example, the proposed technology provides a refiner segment 10, wherein at least a subset of the refining bars $Z_i^{RBi}$ belonging to a particular bar zone $Z_i$ have a geometrical shape that is distinct from the geometrical shape of refining bars $Z_k^{RBk}$ belonging to other bar zones $Z_k$.

Another embodiment of the proposed technology provides a refiner segment 10, wherein the length of refining bars belonging to different bar zones decreases from a largest length for refining bars $Z_1^{RB1}$ belonging to the innermost bar zone $Z_1$, with regard to the center 11 of the refining disc 100, to the smallest length for refining bars $Z_N^{RBN}$ belonging to the outermost bar zone $Z_N$ adjacent the periphery of the refiner segment 10. By providing refining bars belonging to different bar zones with different length dimensions ensures that the open volume on the bar zone remain sufficiently large. With open volume is here intended the area on the refining segment where the material is allowed to flow freely, without interacting with any refining bars. Since the number of provided refining bars become higher towards the periphery of the refining segment, with a purpose of obtaining an efficient flow, the open volume may decrease. This may be compensated by a stepwise shortening of refining bars, i.e., the farther out from the center of the refining segment or refining disc the refining bars are provided, the shorter they are, this is schematically illustrated in e.g., FIG. 3*b*.

Figure 2:
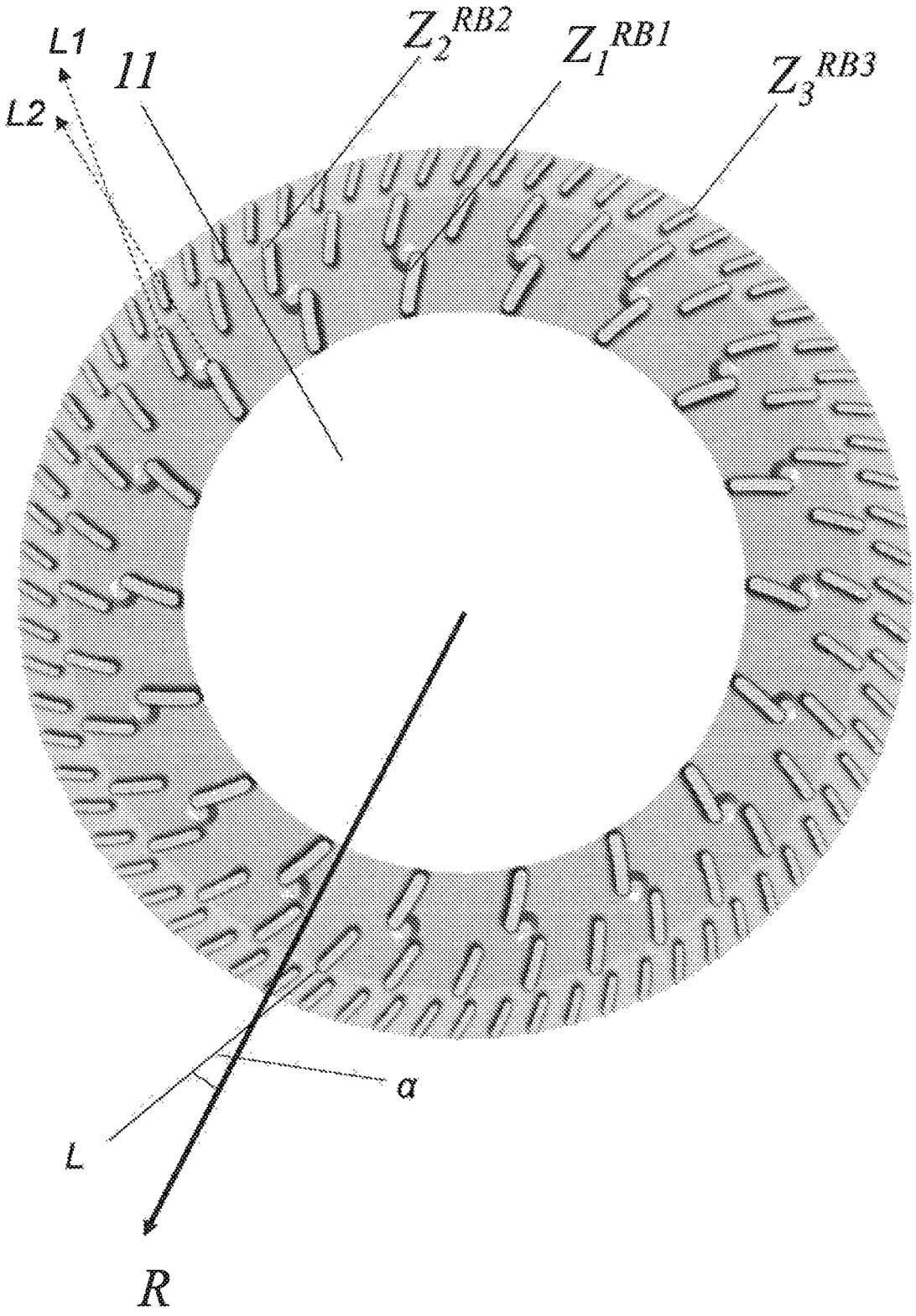
FIG. 2 is a schematic drawing of a refining segment according to the proposed technology where the refining segment completely covers a circular refining disc such as a circular rotor disc.

According to a particular embodiment of the proposed technology there is provided a refiner segment 10, wherein at least a subset of the refining bars $Z_i^{RBi}$ is provided on the surface of the refiner segment 10 in such a way that an angle α is formed between the radial direction of the refiner segment 10 and the length direction of a refining bar $Z_i^{RBi}$. The lower part of FIG. 2 illustrates such an embodiment. The length direction of a particular refining bar is denoted L and it can be seen how this length direction forms an angle α with the radial direction.

A particular version of the above mentioned embodiment provides a refiner segment 10, wherein the angle α formed between the radial direction of the refiner segment 10 and the length direction of a refining bar $Z_i^{RBi}$ defines the bar feeding angle and wherein the angle α takes value in the interval $0° < \alpha \leq 60°$.

Another particular embodiment of the proposed technology provides a refiner segment 10, wherein refining bars $Z_i^{RBi}$ belonging to different bar zones $Z_i$ have different widths, and wherein the widths decreases from a largest width for refining bars $Z_1^{RB1}$ belonging to the innermost bar zone $Z_1$, with regard to the center 11 of the refiner disc 100, to the smallest width for refining bars $Z_N^{RBN}$ belonging to the outermost bar zone $Z_N$ adjacent the periphery of the refiner segment 10. The purpose of this embodiment is the same as in the embodiment described above regarding refining bars having different lengths. That is, it ensures that a satisfactory degree of open volume that can carry the material flow is present on the refining segment even when the number of refining bars increases toward the periphery.

In still another embodiment of the proposed technology the refining segment may be provided on a refining disc 100 that also comprises refining segments 34,34* of p-segment type. FIG. 7 illustrates such an embodiment. Such an embodiment may in particular comprise a refiner disc 100, 20 that comprises the refining segments 10 as has been described earlier, here referred to as c-segments 10, 10* and additional refining segments referred to as p-segments 34, 34*. The p-segments 34, 34* are provided with refining bars to enable an efficient grinding of material flowing in from the c-segments 10. The refining disc 100, 20 may be a rotor refiner disc 100 or a stator refiner disc 20.

It should be noted that the proposed technology may be utilized on both the rotor side of a refiner and on the stator side. The proposed technology may be provided in the form of a refining segment that can be attached a refining disc 100 that in turn can be attached to the rotor 100* or stator 20*. The refining disc 100 may in this particular case be referred to as a segment holder, see FIG. 7 for an illustration. The refining segment may however also be provided in the form of complete integrated disc, thus forming part of, or defining, the refining disc in itself. In this case the refining segment 10 and the refining disc 100 form an integrated structure that can be attached to a rotor 100* or a stator 20*.

A particular embodiment of the proposed technology provides a refiner segment 10, wherein the refiner segment 10 comprises the refiner disc 100. That is, the refining segment 10 can be provided in the shape of a refiner disc that can be either a rotor refiner disc or a stator refiner disc.

According to a particular version of the latter embodiment there is provided a refiner segment 10, wherein the refiner disc 100 is a rotor refiner disc. As was mentioned earlier, the refining segment 10 according to the proposed technology may form part of a refiner disc 100 or be attached to a refiner disc 100. A refining segment may be provided in the shape of a circle, optionally with a removed central area 11, as is shown in e.g. FIG. 2, or in the shape of a circle sector as in FIGS. 3*a*-3*c*. A refiner disc 100 may thus be provided with a number of refiner segments 10 whereby it will either be completely covered by refining segments 10 or partially covered. The refining segment may in particular form part of a rotor disc or equivalently a rotor refiner disc. In case the refiner segment 10 form part of a rotor refiner disc the center area 11 of the rotor refiner disc 100 may comprise a center plate 17.

An alternative embodiment of the proposed technology provides a refiner segment 10 wherein the refiner disc 100 is a stator refiner disc 20*. A schematic cross-sectional view from the side of a stator refiner disc 20* is illustrated on the right side of FIG. 7. In this particular embodiment the stator refiner disc can be provided with a hole in the center area 11. This hole defines an inlet 32 for the refining material.

Figure 5B:
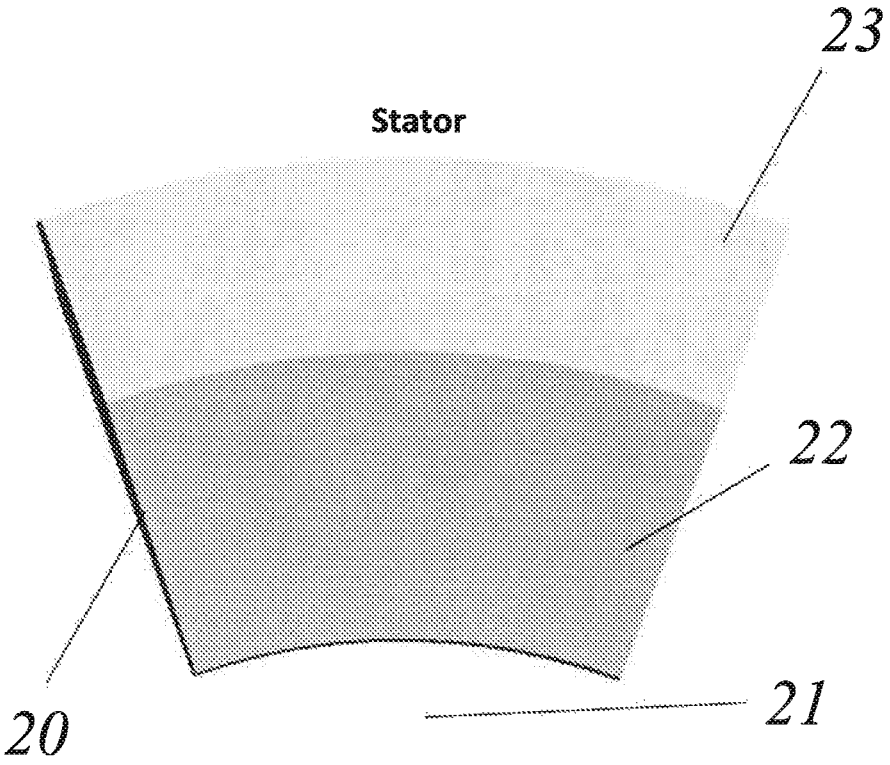
FIG. 5*b* is a schematic diagram of a stator disc that is adapted to cooperate with, for example, a rotor disc according to FIG. 5*a*.
Figure 6:
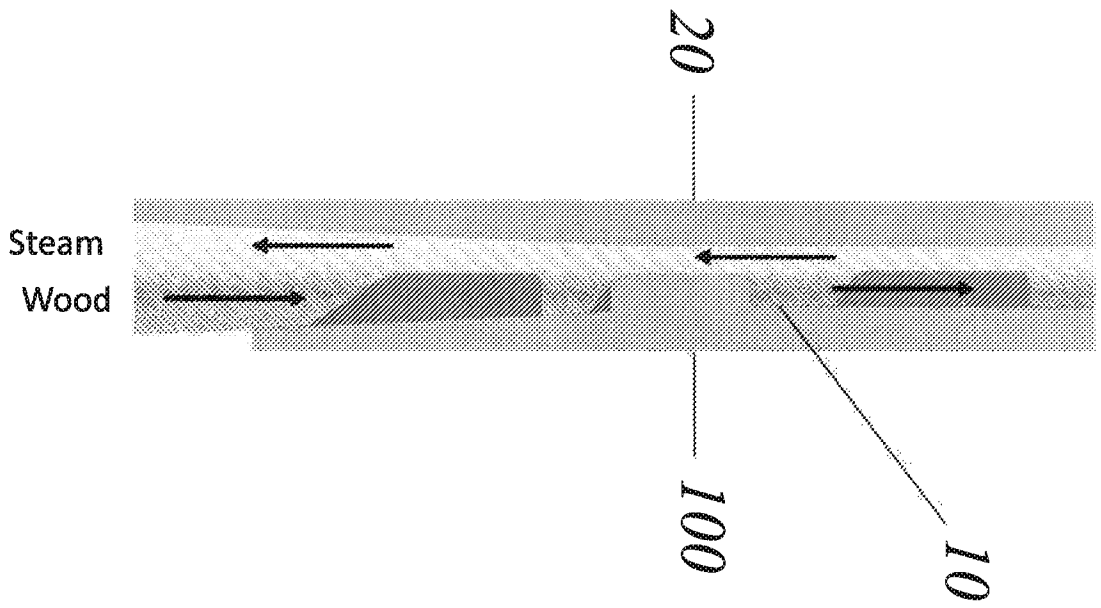
FIG. 6 is a cross-section view from the side of a rotor disc-stator disc pair according to the proposed technology where also potential material- and steam flows are illustrated.

The proposed technology may however also be used in a rotor-stator arrangement or a refiner 1 where the stator disc 20* is adapted to cooperate with a rotor refiner disc 100 that comprises a refining segment as has been described earlier. The stator disc may also be provided with refining segments according to what has been described earlier. The stator disc 20* is adapted to face, and cooperate with, the rotor refiner. The stator refiner disc 20 is provided in the form of an essentially circular shape having a center area provided with a hole that defines a material inlet 32. The stator disc may also be provided with two different but adjacent surface regions, a first surface region that is arranged adjacent to, and encircling, the inlet 32, and a second surface region that is arranged adjacent to, and encircling, the first surface region. The second surface region is essentially planar while the first surface region is inclined relative the second region where the inclination is in a direction opposite the intended material flow direction during use. The fact that the first surface region is inclined relative the second region provides more open volume closer to the center of the stator disc 20*. This open volume can be occupied by water steam and thus provides ample space for any back-travelling steam. FIG. 5*b* and FIG. 6 provides schematic illustrations of such a stator disc. FIG. 5*b* provides a view facing the stator disc while FIG. 6 illustrates how the stator disc interacts with a rotor disc equipped with a refining segment according to the proposed technology.

Another particular embodiment of the proposed technology provides a refiner 1 comprising a rotor refiner disc 10 provided with refining segments as described herein.

The proposed technology also provides a refiner 1 comprising a rotor refiner disc 10 provided with refining segments as described herein and a stator refiner disc 20 as described above. FIG. 8 provides an illustration of a possible refiner where the present invention may be used. To this end the rotor disc 100 may comprise a refining segment according to the proposed technology. The rotor disc 100 is adapted to cooperate with a stator disc 20 according to another aspect of the proposed technology.

Generally, all terms used herein are to be interpreted according to their ordinary meaning in the relevant technical field, unless a different meaning is clearly given and/or is implied from the context in which it is used. All references to a/an/the element, apparatus, component, means, step, etc. are to be interpreted openly as referring to at least one instance of the element, apparatus, component, means, step, etc., unless explicitly stated otherwise. Any feature of any of the embodiments disclosed herein may be applied to any other embodiment, wherever appropriate. Likewise, any advantage of any of the embodiments may apply to any other embodiments, and vice versa. Other objectives, features and advantages of the enclosed embodiments will be apparent from the following description.

The invention claimed is:

1. A refiner segment for a refiner of lignocellulosic material, the refiner segment being part of a refiner disc comprising a center area, wherein the refiner segment comprises:

a number N, N≥2, of bar zones ($Z_i$, i=1, . . . N) arranged at different radial positions with regard to a radial direction R extending from said center area of said refiner disc towards a periphery of said refiner segment, each of said bar zones ($Z_i$) being defined by a corresponding set of refining bars ($Z_i^{RBi}$, i=1,. . . ,M) distributed angularly and encircling the center area, where refining bars ($Z_i^{RBi}$) belonging to different but neighboring bar zones ($Z_i$, $Z_{i+1}$) are angularly offset, wherein refining bars ($Z_i^{RBi}$) belonging to different but neighboring bar zones are arranged in such a way that a tangential direction of a particular refining bar ($Z_k^{RBk}$) belonging to a bar zone ($Z_i$) points in a direction towards the mid-point between two refining bars ($Z_{k+1}^{RBk+1}$) belonging to a neighboring bar zone ($Z_i$, $Z_{i+1}$) and wherein a length of refining bars belonging to different bar zones decreases from a largest length for refining bars ($Z_1^{RB1}$) belonging to an innermost bar zone ($Z_1$), with regard to the center area of said refiner disc, to the smallest length for refining bars ($Z_N^{RBN}$) belonging to an outermost bar zone ($Z_N$) adjacent the periphery of said refiner segment, wherein each refining bar has a feeding angle greater than 0 degrees and less than or equal to 60 degrees, the feeding angle being an angle between a radial direction of the refiner segment and a length direction of a respective refining bar, and wherein the bar zones are distinct and separate from each other, and each refining bar is disposed in a single respective bar zone, and wherein between the refining bars are open areas that extend continuously from the center area of the refiner disc to the periphery of the refiner segment.

2. The refiner segment according to claim 1, wherein the angularly offset refining bars between all neighboring bar zones ($Z_i$) are in the same angular direction, said angular direction being the direction opposite to the intended rotational direction of the refiner segment.

3. The refiner segment according to claim 1, wherein the refining bars in a specific bar zone are distributed angularly in a band of equidistantly spaced refining bars ($Z_i^{RBi}$) that encircles the center of said refiner disc.

4. The refiner segment according to claim 3, wherein different bar zones comprise bands with a different number of equidistantly spaced refining bars ($Z_i^{RBi}$).

5. The refiner segment according to claim 4, wherein the number of equidistantly spaced refining bars ($Z_i^{RBi}$) increases from the lowest number in the innermost bar zone ($Z_1$), with regard to the center of said refiner disc, to the highest number in the outermost bar zone ($Z_N$) adjacent the periphery of said refiner segment.

6. The refiner segment according to claim 5, wherein the number of refining bars ($Z_i^{RBi}$) are doubled for each zone going outwards towards the periphery.

7. The refiner segment according to claim 1, wherein refining bars ($Z_i^{RBi}$) belonging to different bar zones ($Z_i$) have different widths, and wherein the widths decrease from a largest width for refining bars ($Z_1^{RB1}$) belonging to the innermost bar zone ($Z_1$), with regard to the center of said refiner disc, to the smallest width for refining bars ($Z_N^{RBN}$) belonging to the outermost bar zone ($Z_N$) adjacent the periphery of said refiner segment.

8. The refiner segment according to claim 1, wherein said refiner segment comprises the refiner disc.

9. The refiner segment according to claim 1, wherein said refiner disc is a rotor refiner disc.

10. The refiner segment according to claim 9, wherein the center area of said rotor refiner disc comprises a center plate.

11. The refiner segment according to claim 1, wherein said refiner disc is a stator refiner disc.

12. A refiner comprising (1) a rotor refiner disc comprising a refiner segment according to claim 1 and/or a (2) stator refiner disc comprising a refiner segment according to claim 1.

13. A refiner comprising a rotor refiner disc comprising the refiner segment according to claim 1 and a stator refiner disc comprising the refiner segment according to claim 1.

* * * * *